US010113831B2

(12) United States Patent
Moretti

(10) Patent No.: US 10,113,831 B2
(45) Date of Patent: Oct. 30, 2018

(54) GUN STOCK WITH INTERCHANGEABLE CHEEK REST

(71) Applicant: BENELLI ARMI S.P.A, Urbino (Pesaro Urbino) (IT)

(72) Inventor: Luigi Moretti, Collebeato (IT)

(73) Assignee: BENELLI ARMI, S.P.A., Pesaro, Urbino (IT)

( * ) Notice: Subject to any disclaimer, the term of this patent is extended or adjusted under 35 U.S.C. 154(b) by 0 days.

(21) Appl. No.: 15/443,655

(22) Filed: Feb. 27, 2017

(65) Prior Publication Data

US 2017/0254614 A1 Sep. 7, 2017

(30) Foreign Application Priority Data

Mar. 1, 2016 (IT) ..... 10201621445
Mar. 1, 2016 (IT) ..... UB2016A1190

(51) Int. Cl.
*F41C 23/14* (2006.01)
*F41C 23/20* (2006.01)

(52) U.S. Cl.
CPC ..... *F41C 23/14* (2013.01); *F41C 23/20* (2013.01)

(58) Field of Classification Search
CPC ..... F41C 23/14
USPC ..... 42/73
See application file for complete search history.

(56) References Cited

U.S. PATENT DOCUMENTS 717,011 A * 12/1902 Marsland ..... F41C 23/16 42/71.01
2,100,514 A * 11/1937 Miller ..... F41C 23/06 42/71.01
3,710,496 A 1/1973 Gerick et al.
4,120,108 A * 10/1978 Vickers ..... F41C 23/08 42/74
2001/0011434 A1 8/2001 Gussalli
2010/0212204 A1* 8/2010 Koyama ..... F41A 21/24 42/73
2011/0016764 A1 1/2011 Cales
2011/0192067 A1* 8/2011 Troy ..... F41C 23/06 42/73
2011/0302817 A1 12/2011 Debrun et al.
2012/0110884 A1* 5/2012 Criswell ..... F41C 23/14 42/73
2014/0137456 A1* 5/2014 Chiang ..... F41C 23/14 42/73
2014/0259848 A1* 9/2014 Chvala ..... F41C 23/14 42/73

FOREIGN PATENT DOCUMENTS

EP 0708304 A1 4/1996
EP 1396697 A2 3/2004
WO WO 2007/082990 A1 7/2007

* cited by examiner

*Primary Examiner* — Bret Hayes
(74) *Attorney, Agent, or Firm* — R. Neil Sudol; Henry D. Coleman

(57) ABSTRACT

A gun stock with interchangeable cheek rest, including a main body and a cheek rest removably associated with the body and including a supporting structure and a cheek pad that rests on an elastic member associated with the structure; the elastic member is constituted by a leaf spring that is associated with the structure and is easily interchangeable. The cheek rest is applied to the stock body by means of a quick coupling, with or without the use of tools.

7 Claims, 7 Drawing Sheets

GUN STOCK WITH INTERCHANGEABLE CHEEK REST

BACKGROUND OF THE INVENTION

The present invention relates to a gun stock with interchangeable cheek rest.

Gun stocks provided with a part for the resting of the cheek with an adjustable position, known as cheek rest, have long been known.

The possibility to adjust the height of the cheek rest is a need that is strongly felt by shooters for a precise adaptation to the elevation and aiming conditions of the gun.

Generally, in the conventional stocks, the cheek rest is adjusted by acting on one or more adjustment screws. Such stock and adjustable cheek rest assembly is constructively complicated and expensive and the adjustment of the cheek rest is difficult.

US2011/016764A1 discloses a cheek rest strapped onto a firearm stock to allow the user to get a tighter cheek weld when using rifle scopes. The cheek rest can be altered to fit various manufactured stocks. An adjustable strapping system provides greater tension on the bottom of the rest ensuring it mates tightly with the stock.

U.S. Pat. No. 3,710,496 discloses a stock with a cheek rest the position of which can be adjusted both vertically and longitudinally by means of adjustment screws. The assembly constituted by the stock and the cheek rest is furthermore provided with elastic members adapted to absorb the forces generated by the recall of the firearm.

EP0708304 discloses a stock with a cheek rest that can be adjusted vertically by means of spacers of different thickness to be applied to posts arranged between the stock and the cheek rest, without using adjustment screws.

The manufacture and the systems for adjusting stocks with adjustable cheek rest described above and the other systems of the background art are generally constructively complicated, expensive and awkward to use.

OBJECTS OF THE INVENTION

The aim of the present invention is to provide a stock with interchangeable cheek rest that is constructively simple and economical.

Within the scope of this aim, an object of the invention is to provide a stock with interchangeable cheek rest that offers superior comfort, ensuring soft resting of the cheek in all conditions in which the firearm is brought to firing position, which vary as a function of the style of each individual shooter.

Another object of the invention is to provide a stock with interchangeable cheek rest that allows to change easily and simply the elastic characteristics of the cheek rest.

A further object of the invention is to allow to replace the cheek rest with other cheek rests of different heights or having different shapes or different hardnesses.

Another object of the present invention is to provide an assembly which, by virtue of its particular constructive characteristics, is capable of giving the greatest assurances of reliability and safety in use.

SUMMARY OF THE INVENTION

This aim and these and other objects that will become better apparent hereinafter are achieved by a gun stock with interchangeable cheek rest, comprising a main body and a cheek rest removably associated with said body; said cheek rest comprising a supporting structure and a cheek pad that rests on an elastic member associated with said structure; said elastic member comprising a leaf spring; said leaf spring being removable from said structure and being replaceable with a leaf spring having different characteristics of elasticity.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
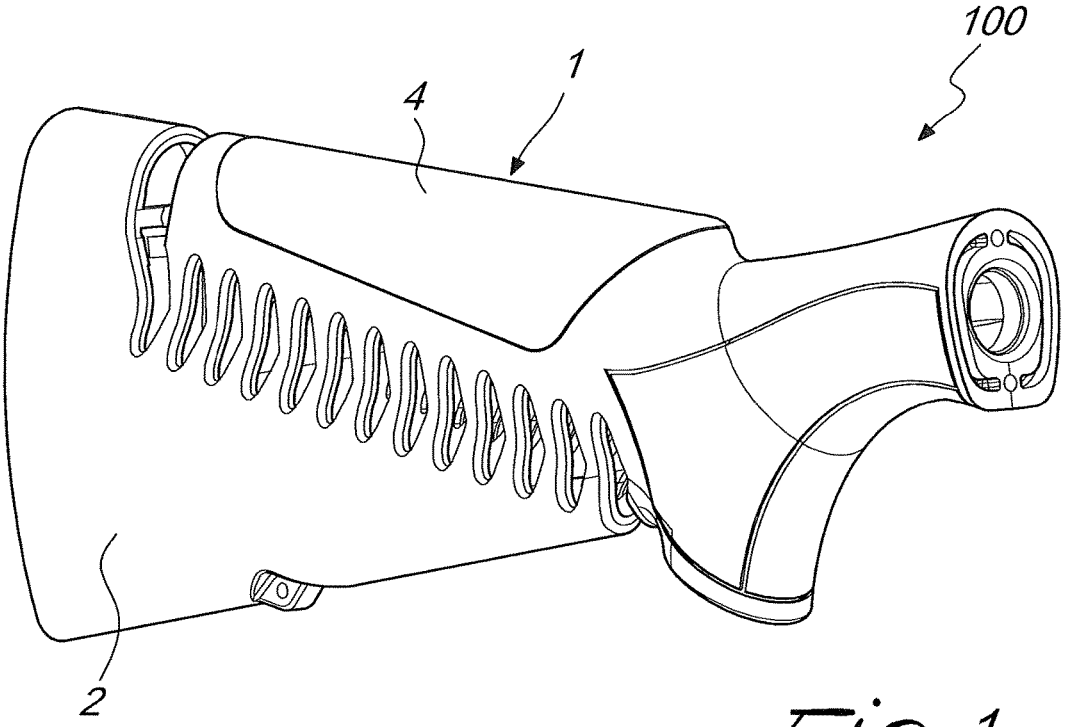
FIG. 1 is a perspective view of a stock of a gun provided with the interchangeable cheek rest according to the present invention.
Figure 2:
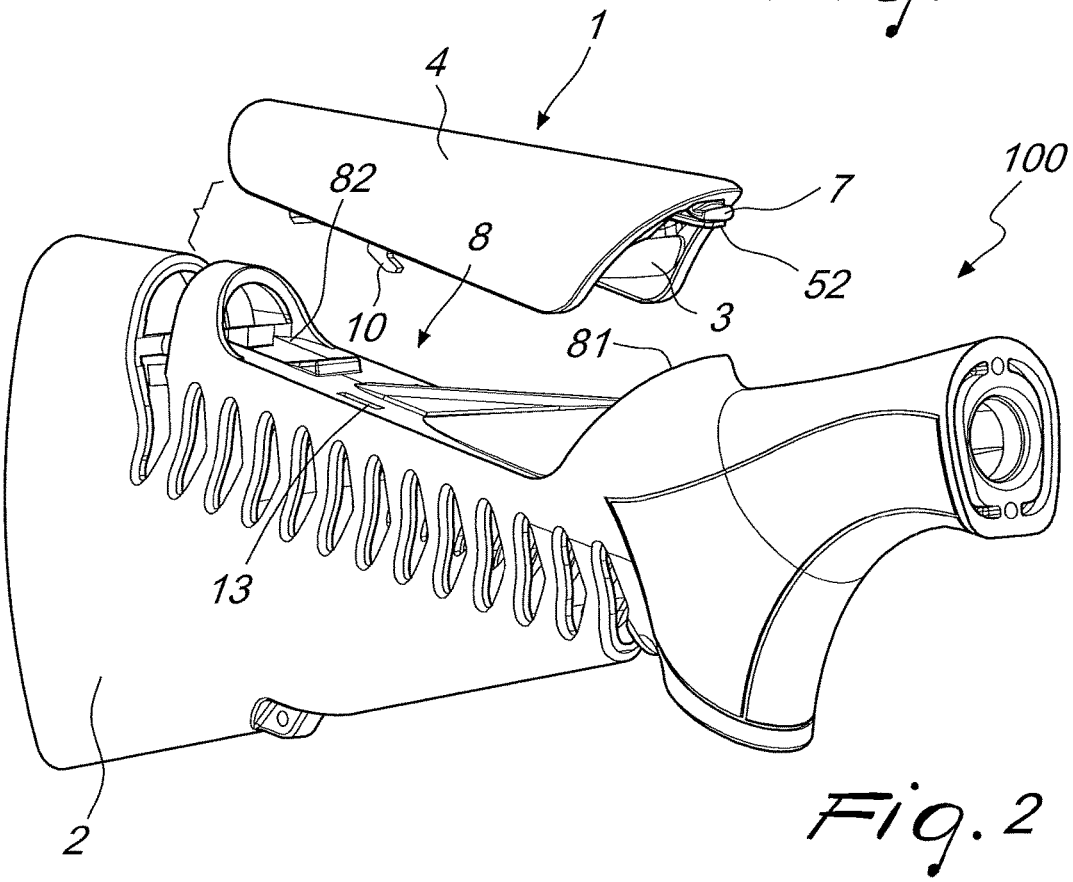
FIG. 2 is a partially exploded perspective view of the stock of the preceding figure, shown with the cheek rest separated from the stock.
Figure 3:
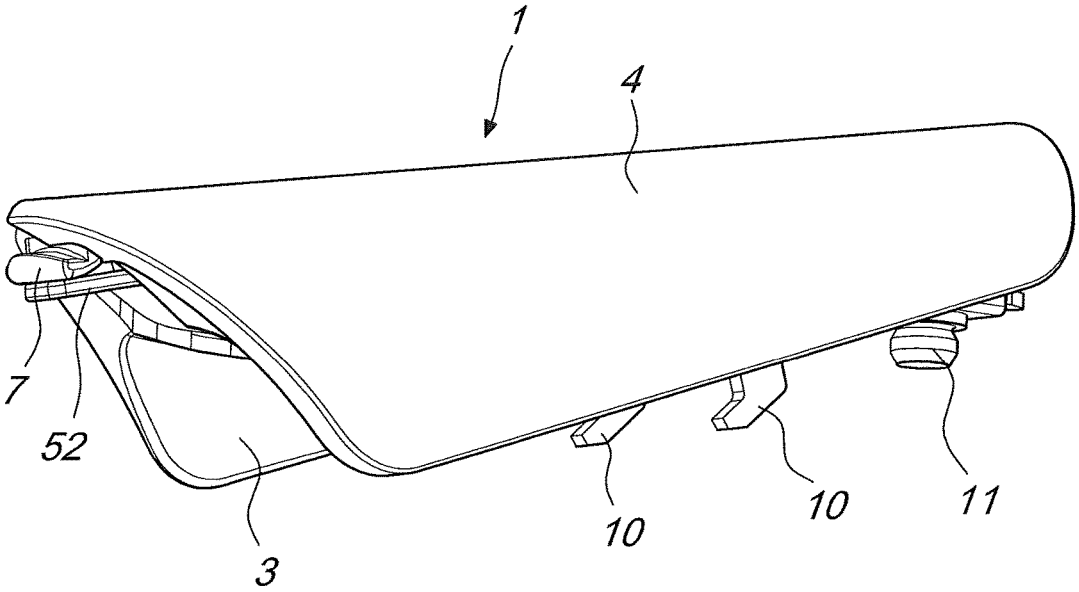
FIG. 3 is a perspective view of the cheek rest.
Figure 4:
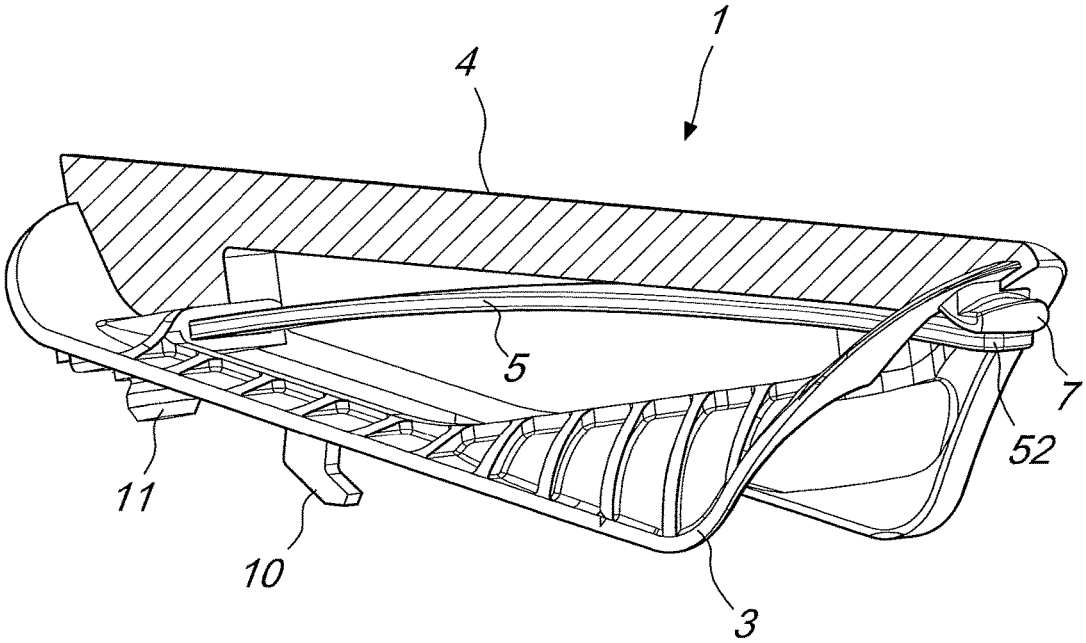
FIG. 4 is a partially cutout perspective view of the cheek rest.

With reference to the cited figures, the stock with interchangeable cheek rest according to the invention, globally designated by the reference numeral 100, includes a main body 2 and a cheek rest 1 detachably associated thereto.

According to the present invention, the cheek rest 1 is interchangeable and is associated with the main body 2 by means of a quick coupling.

The cheek rest 1 includes a supporting structure, globally designated by the reference numeral 3, and a cheek pad 4, which rests against an elastic member 5 associated with the structure 3.

Advantageously, the cheek resting pad 4 is made of soft material, such as a gel or polyurethane.

The elastic member 5 is easily removable to be replaced with another member having different elastic characteristics.

The elastic member 5 is advantageously constituted by a leaf spring, which can be inserted and removed from the structure 3 when the cheek rest 1 is separated from the body of the stock 2.

According to the present invention, the leaf spring 5 is an elastic blade, which has a first end 51 that can be engaged in a seat 6 formed in the structure 3 of the cheek rest, and a second end 52 that is adapted to abut against an abutment member 7 formed in the structure 3 in a position that is opposite to the position of the seat 6.

Figure 5:
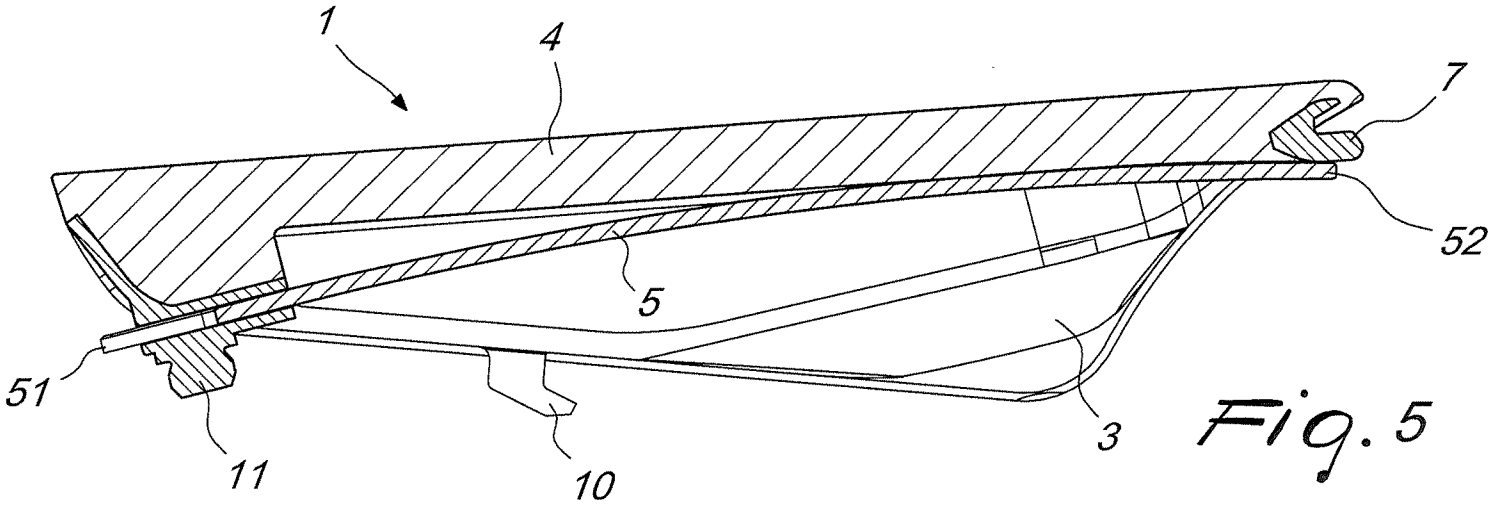
FIG. 5 is a longitudinal sectional view of the cheek rest, shown with the leaf spring member inserted in the structure, in the position of use.

FIG. 5 is a view of the leaf spring 5 inserted in the structure 3 in the operating position, in which the cheek pad 4 substantially rests against the leaf spring 5, which determines the degree of resistance to pressure on the part of the pad 4 at the cheek of the shooter.

If one wishes to vary the resting characteristics of the cheek rest, it is possible to replace the leaf spring 5 with another one having different elastic characteristics.

Figure 6:
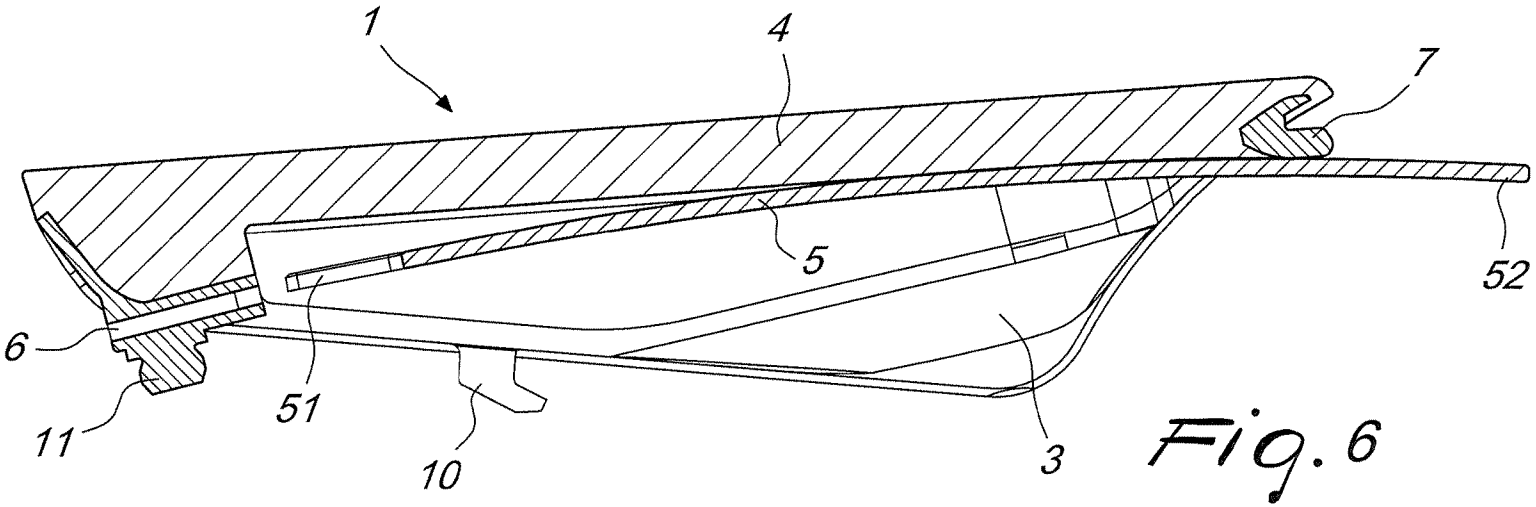
FIG. 6 is a view, similar to the preceding one, showing the leaf spring member partially extracted from the structure.
Figure 7:
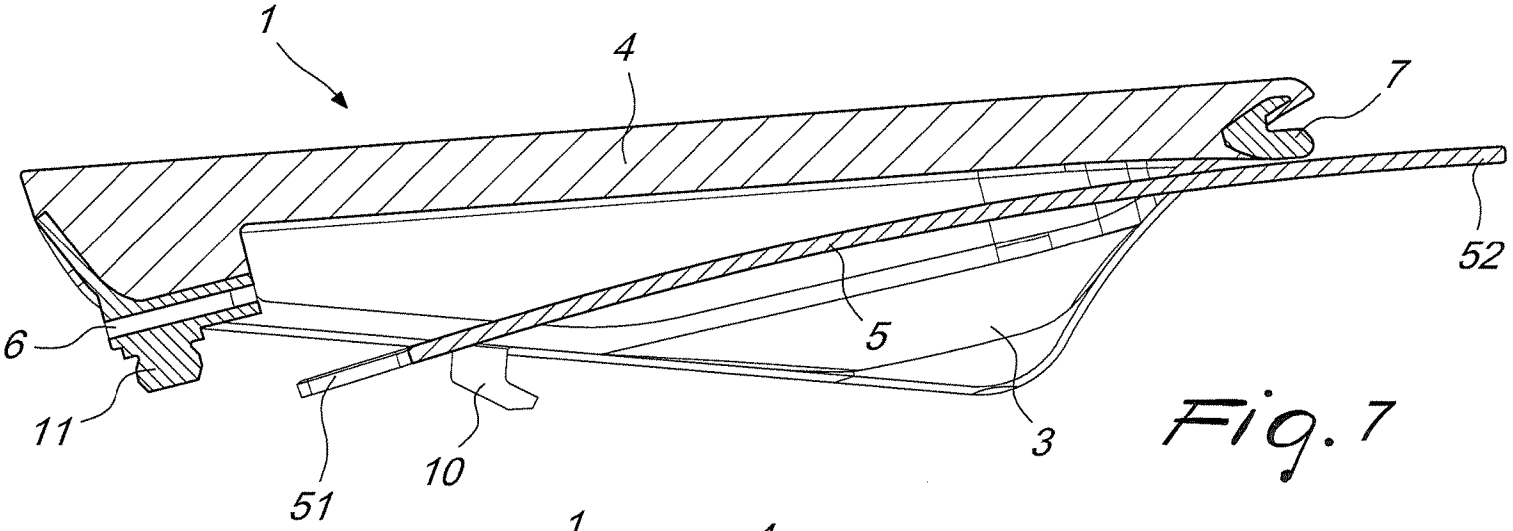
FIG. 7 is a view, similar to the preceding one, which shows a successive step of the extraction motion.
Figure 8:
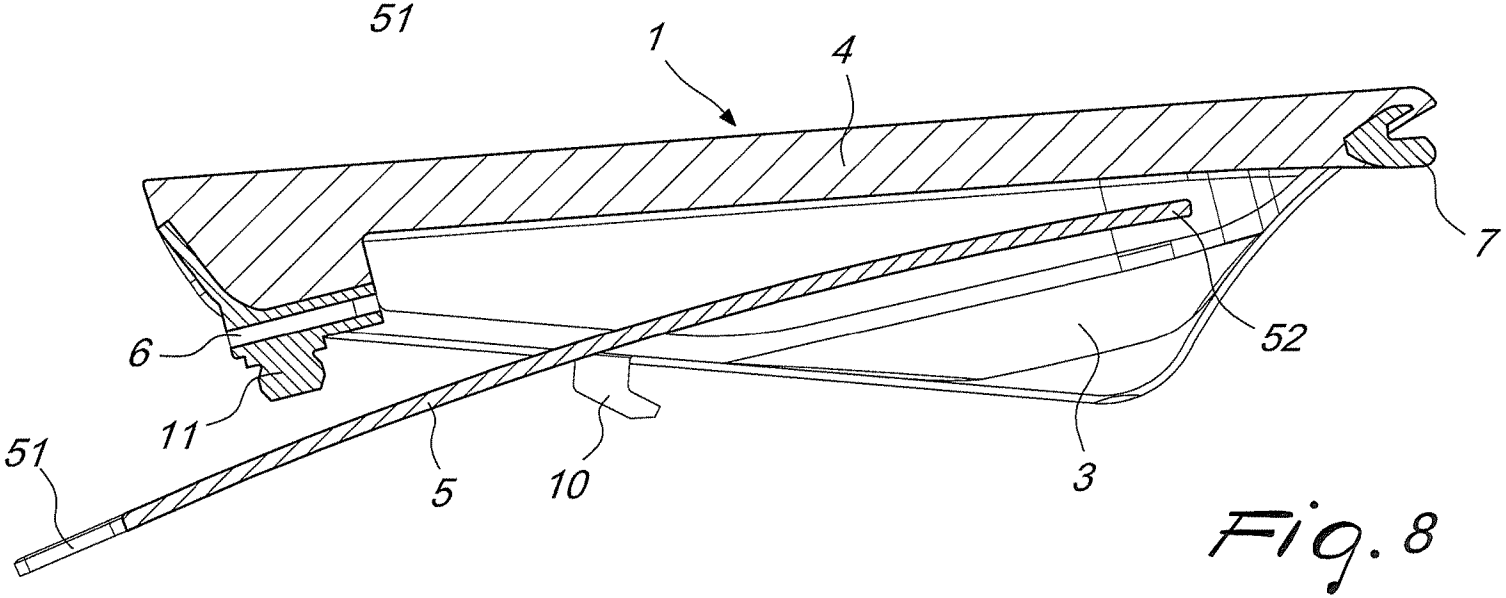
FIG. 8 is a view, similar to the preceding one, showing a final step of the extraction motion.

Replacement of the leaf spring 5 is performed by extracting the spring from the seat 6, as can be seen in FIG. 6, enough to then pass the leaf spring 5 below the structure 3, as shown in the sequence of FIGS. 7 and 8.

The assembly of the leaf spring 5 in the structure 3 occurs by operating in reverse.

Replacement of the leaf spring 5 can occur when the cheek rest 1 is separated from the body of the stock 2.

According to the present invention, the cheek rest 1 is interchangeable and is associated with the main body 2 by means of a quick coupling system.

The quick coupling system for coupling the cheek rest 1 to the body of the stock 2 includes a front tooth, which is constituted by the abutment member 7 described above, which can be inserted in a front recess, not visible in the figures, which is formed in the body of the stock 2 at a front edge 81 of an open region 8 that is formed in the body of the stock 2 and is adapted to accommodate the cheek rest 1.

According to a first aspect of the invention, the quick coupling system further includes a mushroom head 11 that is formed in the rear region of the structure 3 of the cheek rest 1, i.e., in a region that is substantially opposite the position of the abutment member 7.

The head 11 may also have any other appropriately contoured shape.

The mushroom head 11 protrudes downwards from the structure 3 and can be inserted in a hole that is formed proximate to a rear edge 82 of the open region 8 that is formed in the body of the stock 2 and is adapted to accommodate the cheek rest 1.

Figure 9:
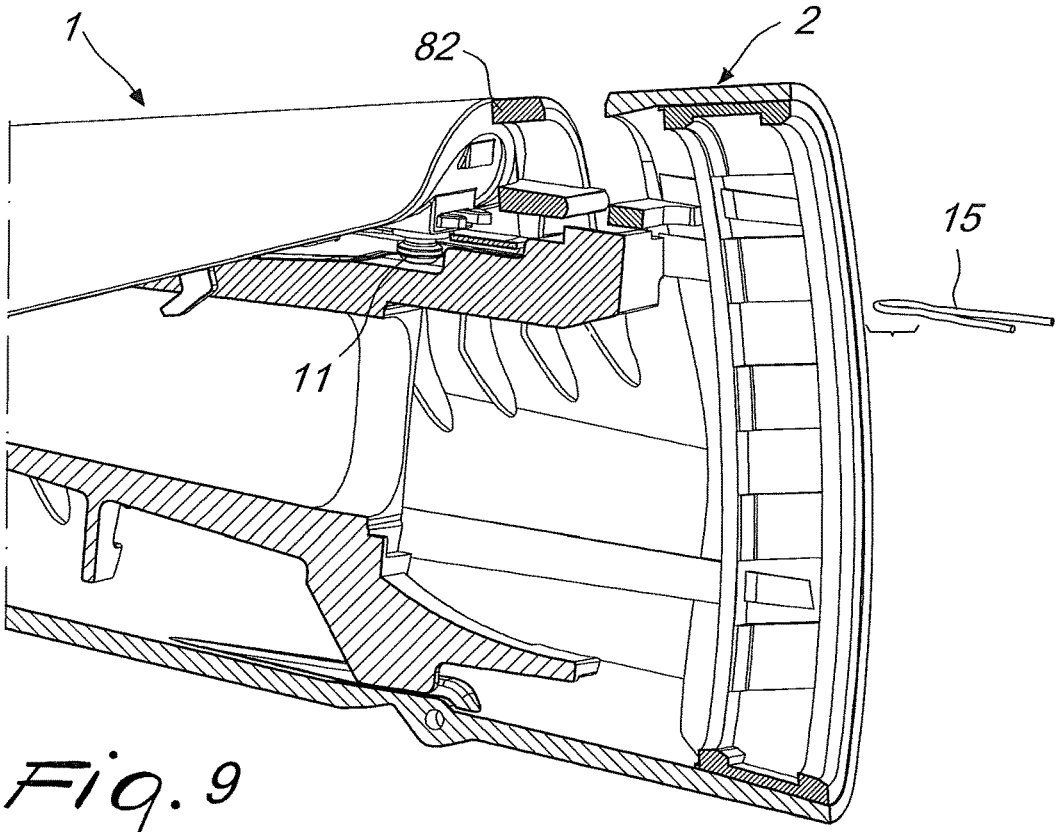
FIG. 9 is a partially exploded cutout perspective view of the rear locking system of the cheek rest by means of a hairpin spring.
Figure 10:
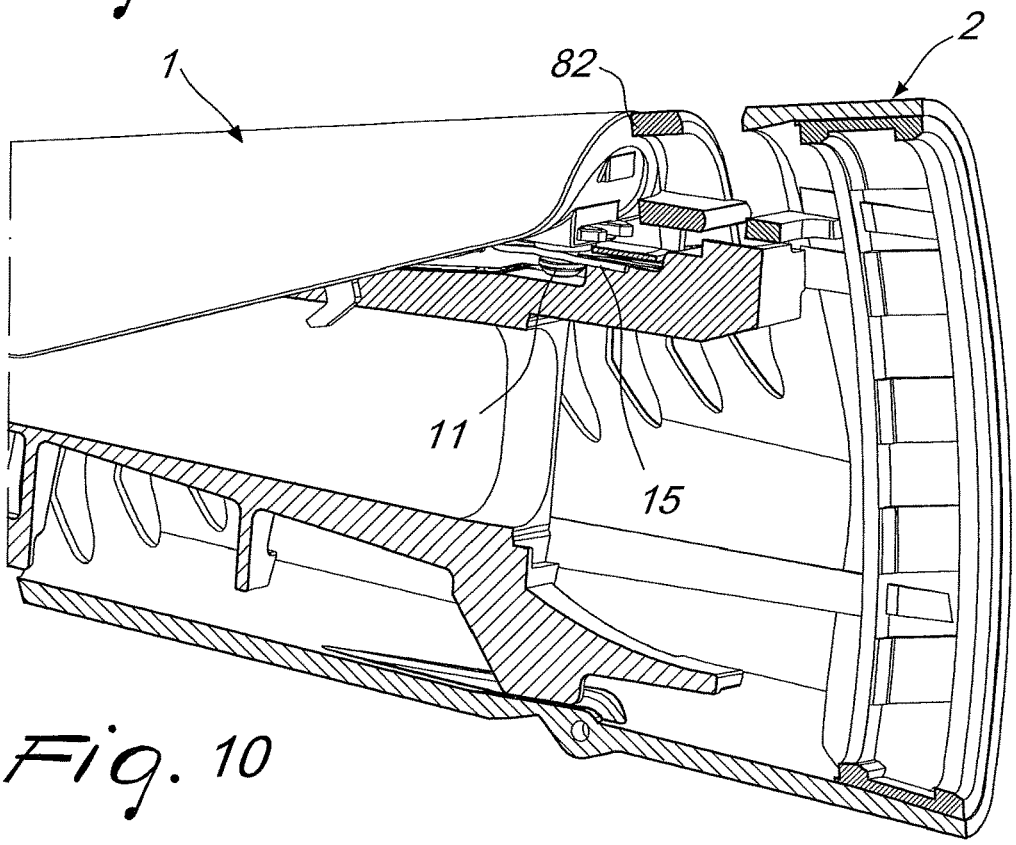
FIG. 10 is a view, similar to the preceding one, showing the system in the locked position.

The insertion of the mushroom head 11 in the hole of the rear edge 82 occurs by snap action due to the presence of elastic members, constituted by a hairpin-shaped spring 15, as can be seen in FIGS. 9 and 10.

The cheek rest 1 is associated with the body of the stock 2 by inserting the abutment member 7 in the front recess formed in the body of the stock 2 at the front edge 81 and by then pressing the cheek rest 1 against the body of the stock 2 so that the mushroom head 11 is inserted in the hole of the rear edge 82, engaging the hairpin spring 15, which locks by snap action the mushroom head 11, locking the cheek rest 1 in position.

In the locking system having the hairpin spring 15, shown in FIGS. 9 and 10, the cheek rest 1 can be assembled and disassembled with or without tools.

The snap acting engagement system described above is advantageously of the type described in EP1396697.

Figure 11:
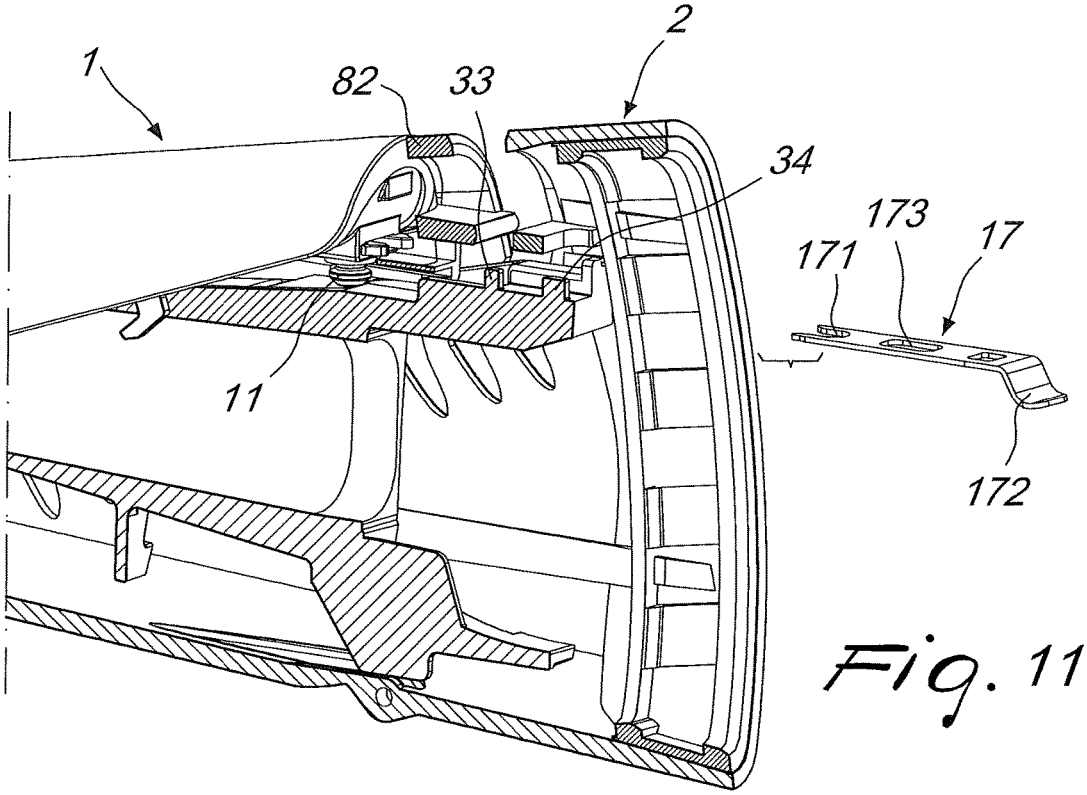
FIG. 11 is a partially exploded cutout perspective view showing the rear locking system of the cheek rest by means of a small movable plate.
Figure 12:
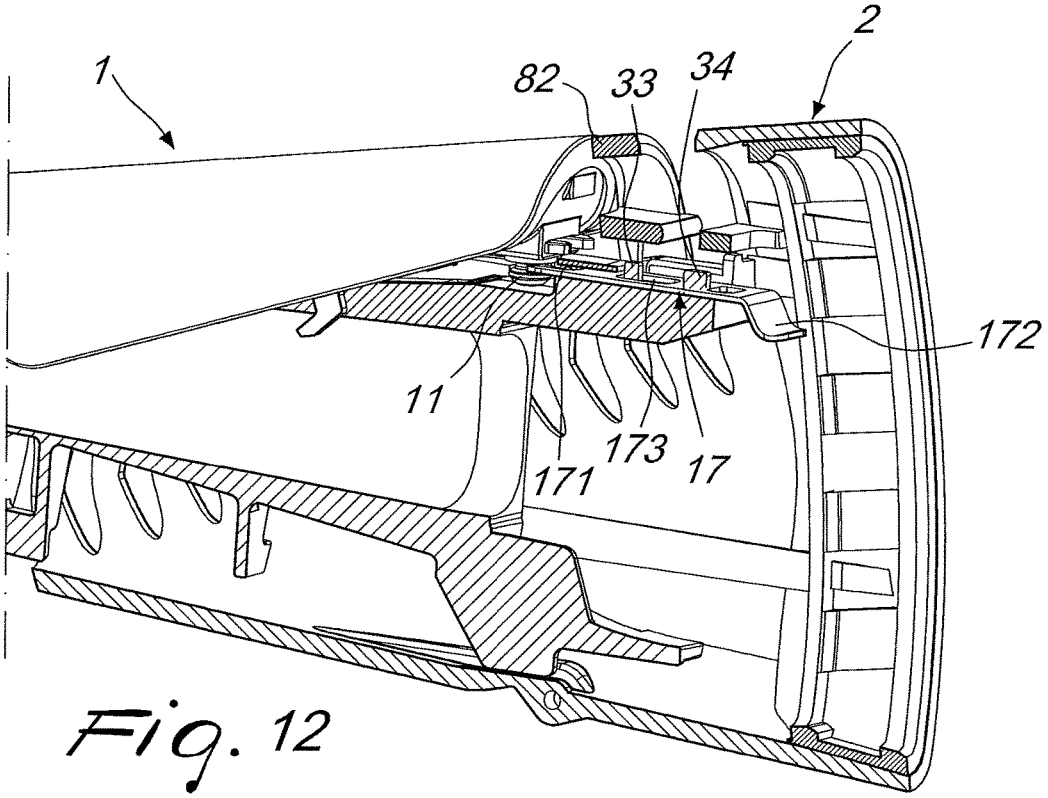
FIG. 12 is a view, similar to the preceding one, showing the system assembled with the small plate in the open position.
Figure 13:
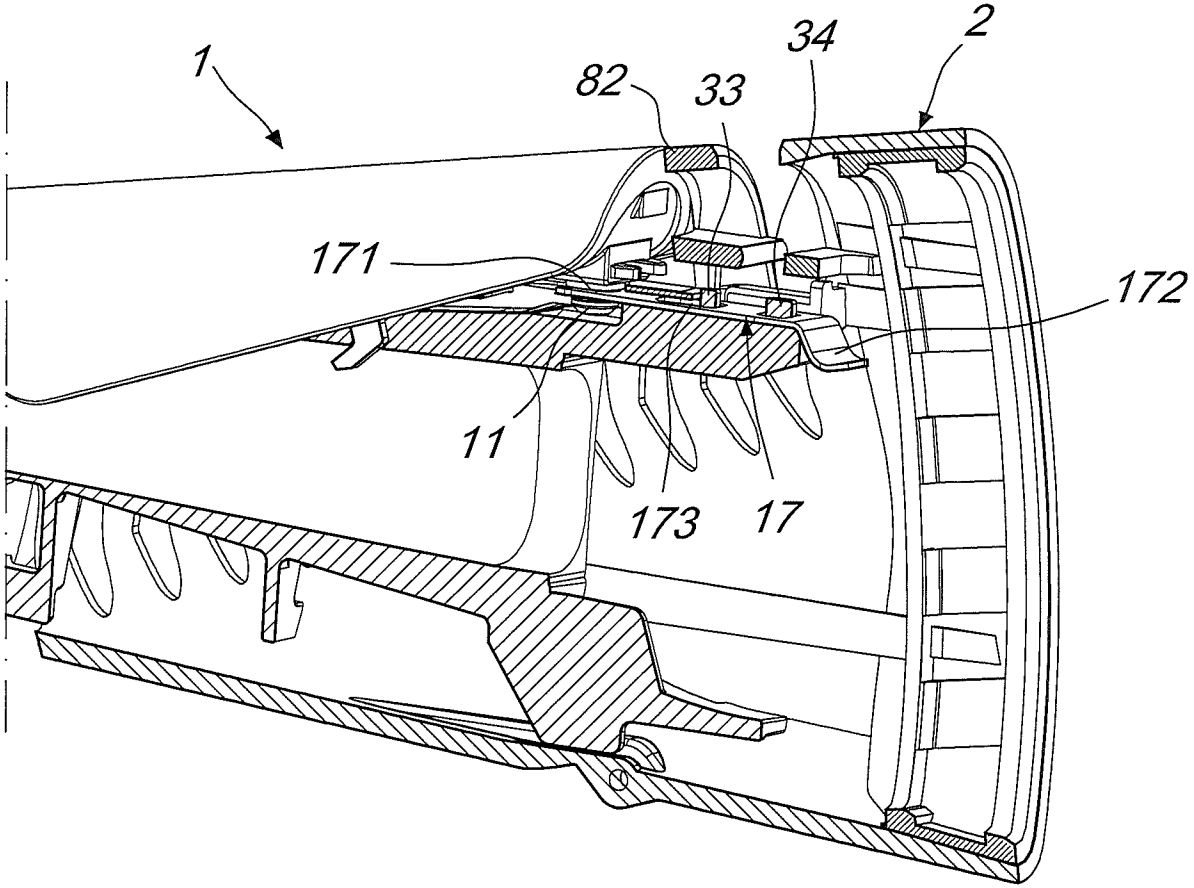
FIG. 13 is a view, similar to the preceding one, showing the system in the locked position.

According to a further aspect of the invention, shown in FIGS. 11-13, the quick coupling system includes a flexible small plate 17, which is visible in FIGS. 11-13.

The small plate 17 is provided with a fork-shaped front part 171 in order to allow coupling to the mushroom head 11 of the structure 3 of the cheek rest 1.

A rear part 172 of the small plate 17 is conveniently shaped to allow easy grip and handling of the small plate on the part of the user.

The small plate 17 also has at least one slot 173 which engages protrusions 33 and 34, formed in the structure 3, acting as a stroke limiter and retention of the small plate 17.

The small plate 17 is made to slide between a locked position, visible in FIG. 13, wherein the small plate 17 locks the mushroom head 11, and an open position, visible in FIG. 12, in which the fork-shaped front part 171 releases the mushroom head 11 and the cheek rest can be raised and removed from the body of the stock 2.

The cheek rest 1 can be assembled-disassembled even without tools.

Preferably, the structure 3 also includes a pair of hooks 10, formed on the sides of the structure and adapted to engage respective lateral seats 13 formed on the lateral edges of the open region 8 of the body of the stock 2.

The cheek rest 1 can be easily mounted on the body of the stock 2 by inserting the abutment member 7 in the front recess, formed in the body of the stock 2, and simultaneously the lateral teeth 10 in the respective lateral seats 13, formed on the lateral edges of the open region 8 of the body of the stock 2, making the cheek rest perform a combined rotary and translational motion and finally pressing at the rear in order to engage by snap action the mushroom head 11 in the hole formed near the rear edge 82 of the open region 8 in which the cheek rest engages.

In practice it has been found that the invention achieves the intended aim and objects, a stock with interchangeable cheek rest having been provided which is constructively simple and at the same time extremely functional.

The stock with interchangeable cheek rest according to the present invention ensures high comfort by virtue of the fact that the surface covered by the soft material in the face resting region is very large and this allows soft resting in all firing positions, which vary as a function of the style of each individual shooter.

The aspect of absorbing recoil and the vibrations toward the face is fundamental, especially for shooters that produce large fire volumes with cartridges of considerable weight, for example in duck hunting, etc.

A further advantage of the present invention resides in the possibility to vary the elastic characteristics of the cheek rest, since the leaf spring can be replaced easily and rapidly with leaf springs having different elastic characteristics.

The cheek rest can in fact be marketed with multiple springs having different rigidity, by virtue of their low cost, so that the shooter can choose the most suitable one according to his requirements.

Another advantage of the present invention is the modularity of the stock and cheek rest assembly. The cheek rest can be disassembled easily from the stock and can be replaced with or without tools and this allows to replace the original cheek rest with cheek rests of different heights or different shapes or different hardnesses.

The materials used, as well as the dimensions, may of course be any according to the requirements and the state of the art.

This application claims the priority of Italian Patent Application No. UB2016A001190 (corresponding to No. 102016000021445), filed on 1 Mar. 2016, the subject matter of which is incorporated herein by reference.

The invention claimed is:

1. A gun stock comprising:

a main body; and a cheek rest removably coupled to said main body, wherein:

said cheek rest includes a supporting structure and a cheek pad;

said supporting structure includes a leaf spring having a first end and a second end;

said supporting structure is formed with a seat and an abutment member spaced from one another;

said first end of said leaf spring is removably inserted in said seat;

said second end of said leaf spring abuts against said abutment member; and said cheek pad rests on said leaf spring.

2. The gun stock according to claim 1, wherein said cheek pad is made of a material taken from the group consisting of a gel and polyurethane.

3. The gun stock according to claim 1, wherein said cheek rest is coupled to said main body by means of a quick coupling system.

4. The gun stock according to claim 3, wherein said quick coupling system comprises:

a front tooth constituted by said abutment member, said abutment member being insertable in a front recess formed in said main body at a front edge of an open region formed in said main body and adapted to receive said cheek rest; and a mushroom head formed at the rear in said supporting structure, in a position that is opposite to the position of said abutment member, said mushroom head protruding downward from the supporting structure and being insertable in a rear hole formed near a rear edge of said open region formed in said main body, said rear hole comprising a hairpin spring adapted for snap engagement of said mushroom head.

5. The gun stock according to claim 4, wherein said supporting structure comprises hooks formed on sides of said supporting structure and adapted to engage respective lateral seats formed on lateral edges of said open region of the main body.

6. The gun stock according to claim 3, wherein said quick coupling system comprises:

a front tooth constituted by said abutment member, said abutment member being insertable in a front recess formed in said main body at a front edge of an open region formed in said main body and adapted to accommodate said cheek rest; and a mushroom head formed at a rear of said supporting structure, in a position that is opposite to said abutment member, said mushroom head protruding downward from said supporting structure and being adapted to be inserted in a rear hole formed near a rear edge of said open region formed in said main body, said mushroom head being engageable by a small plate associated with said supporting structure.

7. The gun stock according to claim 6, wherein said small plate has:

a front part that is fork-shaped and is adapted to engage said mushroom head;

a rear part shaped so as to allow an easy grip and handling of the small plate by the user; and at least one slot that engages protrusions formed in the supporting structure and acting as stop and retention members for said small plate, said small plate being configured to slide between a locking position of said mushroom head and a position in which said front part releases said mushroom head, allowing the separation of said cheek rest from said main body.

* * * * *